US006216774B1

(12) United States Patent
Tsunoda

(10) Patent No.: US 6,216,774 B1
(45) Date of Patent: Apr. 17, 2001

(54) HEAT EXCHANGER

(75) Inventor: Tadashi Tsunoda, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/269,742

(22) PCT Filed: Oct. 17, 1997

(86) PCT No.: PCT/JP97/03848

§ 371 Date: Apr. 6, 1999

§ 102(e) Date: Apr. 6, 1999

(87) PCT Pub. No.: WO98/16790

PCT Pub. Date: Apr. 23, 1998

(30) Foreign Application Priority Data

Oct. 17, 1996 (JP) ..... 8-275058

(51) Int. Cl.[7] ..... F28D 7/02; F28F 3/00

(52) U.S. Cl. ..... 165/165; 165/166

(58) Field of Search ..... 165/165, 166, 165/165 B, DIG. 399

(56) References Cited

U.S. PATENT DOCUMENTS

| | | | | |
|---|---|---|---|---|
| 326,839 | * | 9/1885 | Braithwaite et al. | 165/DIG. 399 |
| 1,941,365 | * | 12/1933 | Patterson et al. | 165/166 |
| 2,367,223 | * | 1/1945 | Larrecq | 165/166 |
| 3,513,907 | * | 5/1970 | Hughes | 165/166 |
| 3,584,682 | | 6/1971 | Leedham et al. . | |
| 3,590,917 | * | 7/1971 | Huber | 165/166 |
| 3,847,211 | * | 11/1974 | Fischel et al. | 165/166 |
| 4,131,159 | * | 12/1978 | Long | 165/166 |
| 4,314,607 | * | 2/1982 | DesChamps | 165/DIG. 399 |
| 4,343,355 | * | 8/1982 | Goloff et al. | 165/16 |
| 4,384,611 | * | 5/1983 | Fung | 165/166 |
| 4,475,589 | * | 10/1984 | Mizuno et al. | 165/166 |
| 4,527,622 | | 7/1985 | Weber . | |
| 5,340,664 | | 8/1994 | Hartvigsen . | |

FOREIGN PATENT DOCUMENTS

| | | |
|---|---|---|
| 24 08 462 | 8/1975 | (DE) . |
| 0 492 799 | 7/1992 | (EP) . |
| 0 796 986 | 9/1997 | (EP) . |
| 57-2983 | 1/1982 | (JP) . |
| 57-500945 | 5/1982 | (JP) . |
| 8-178578 | 7/1996 | (JP) . |

* cited by examiner

*Primary Examiner*—Ira S. Lazarus
*Assistant Examiner*—Tho Duong
(74) *Attorney, Agent, or Firm*—Arent Fox Kintner Plotkin & Kahn PLLC

(57) ABSTRACT

In a heat exchanger which is constructed such that heat-transfer plates S1, S2 in the form of a quadrilateral are bent at fold lines in a zigzag fashion to form combustion gas passages 4 and air passages 5 alternately in a circumferential direction, arrangement is made to enhance material yield and to facilitate brazing of components for formation of a fluid duct. Thus radially outer peripheral walls 6, **8*o*, 10*o* and radially inner peripheral walls 7, 8*i*, 10*i*, respectively, are brazed to fold lines at outer peripheries and inner peripheries of the heat-transfer plates S1, S2 to form a duct 13 continuous to a combustion gas inlet 11, a duct 14 continuous to a combustion gas outlet 12, a duct 17 continuous to an air passage inlet 15, and a duct 18 continuous to an air passage outlet 16**.

1 Claim, 9 Drawing Sheets

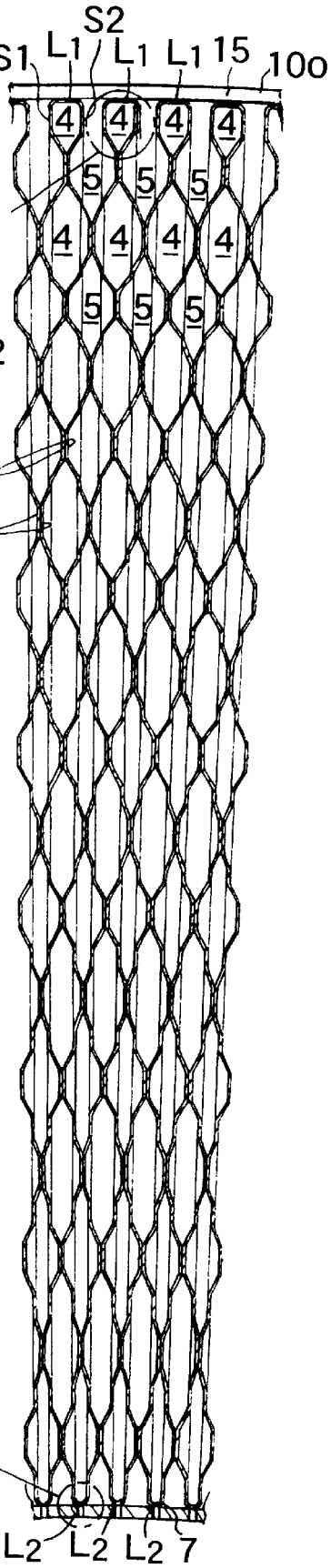
FIG.5
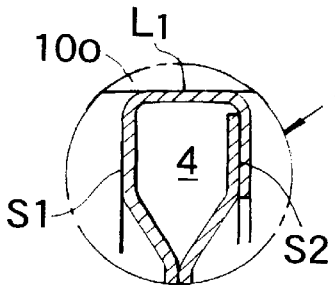
FIG. 5A
FIG. 5B
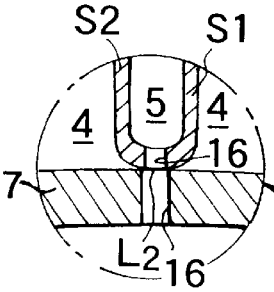

HEAT EXCHANGER

FIELD OF THE INVENTION

The present invention relates to an annular-shaped heat exchanger including high-temperature fluid passages and low-temperature fluid passages defined alternately by folding a plurality of first heat-transfer plates and a plurality of second heat-transfer plates in a zigzag fashion.

BACKGROUND ART

Such heat exchanger is known from Japanese Patent Application Laid-open No.57-2983. There is also a heat exchanger known from Japanese Patent Application Laid-open No.59-183296, which includes high-temperature fluid passages and low-temperature fluid passages defined alternately between heat-transfer plates disposed in parallel, and outlets and inlets for a high-temperature fluid and a low-temperature fluid, which are defined by cutting opposite ends of each of the heat-transfer plates into angle shapes.

When ducts are connected to the high-temperature fluid passages and the low-temperature fluid passages in a heat exchanger made of a metal, it is necessary to bond ends of a partition plate forming the duct to the heat-transfer plates of the heat exchanger by brazing. The heat exchanger in which the opposite ends of each of the heat-transfer plates are cut into the angle shape, as described in the above Japanese Patent Application Laid-open No.59-183296, suffers from the following problem: The material yield for the heat-transfer plates is naturally poor, and it is necessary to braze the partition plate to the apex of the end surface resulting from the cutting into the angle shape. For this reason, it is difficult to carry out the brazing operation because of a small brazing area, and moreover, it is difficult to provide a sufficient brazing strength.

DISCLOSURE OF THE INVENTION

The present invention has been accomplished with the above circumstances in view, and it is an object of the present invention to provide a heat exchanger in which a good material yield is provided and moreover, it is easy to carry out the brazing of a member for forming a fluid duct.

To achieve the above object, according to an aspect and feature of the present invention, there is provided a heat exchanger which is formed from a folding plate blank comprising a plurality of first quadrilateral heat-transfer plates and a plurality of second quadrilateral heat-transfer plates which are alternately connected together through first and second folding lines, the folding plate blank being folded in a zigzag fashion along the first and second folding lines, thereby defining axially extending high-temperature and low-temperature fluid passages alternately in a circumferential direction, radially outer peripheral walls are brazed to the plurality of first folding lines located on a radially outer side and radially inner peripheral walls are brazed to the plurality of second folding lines located on a radially inner side, thereby closing radially outer and inner peripheries of the axially extending high-temperature and low-temperature fluid passages, while defining high-temperature fluid ducts connected to the high-temperature fluid passages and low-temperature fluid ducts connected to the low-temperature fluid passages; a high-temperature fluid passage inlet and a high-temperature fluid passage outlet are formed in openings at axially opposite ends of the high-temperature fluid passages; and projection stripes provided on the first and second heat-transfer plates are brazed to one another, thereby closing axially opposite ends of the low-temperature fluid passages, while defining a low-temperature fluid passage inlet in one of the radially outer and inner peripheral walls on the side of the high-temperature fluid passage outlet, and a low-temperature fluid passage outlet on the other of the radially outer and inner peripheral walls on the side of the high-temperature fluid passage inlet.

With the above arrangement, the radially outer peripheral walls are brazed to the plurality of first folding lines located on the radially outer side and the radially inner peripheral walls are brazed to the plurality of second folding lines located on the radially inner side in order to define the high-temperature fluid ducts connected to the high-temperature fluid passages and the low-temperature fluid ducts connected to the low-temperature fluid passages. Therefore, it is unnecessary to carry out a special working treatment in order to form brazed portions on the first and second heat-transfer plates, leading not only to a reduced number of working steps, but also to an increased brazing strength, as compared with the case where the first and second heat-transfer plates are brazed to the cut end surfaces.

In addition, the high-temperature fluid passage inlet and the high-temperature fluid passage outlet are defined in the openings at the axially opposite ends of the high-temperature fluid passages, and the projection stripes provided on the first and second heat-transfer plates are brazed to one another to close the axially opposite ends of the low-temperature fluid passages, while defining the low-temperature fluid passage inlet in one of the radially outer and inner peripheral walls on the side of the high-temperature fluid passage outlet, and the low-temperature fluid passage outlet on the other of the radially outer and inner peripheral walls on the side of the high-temperature fluid passage inlet. Therefore, even if the first and second heat-transfer plates are formed into a simple quadrilateral shape to enhance the material yield, the outlets and inlets for a high-temperature fluid and a low-temperature fluid can be defined. Moreover, the projection stripes are used for closing the opposite ends of the low-temperature fluid passages and hence, it is unnecessary to provide flaps in a projecting manner on the first and second heat-transfer plates in place of the projection stripes, whereby the material yield can be further enhanced.

BRIEF DESCRIPTION OF THE DRAWINGS

FIGS. 1 to 9 show one embodiment of the present invention, wherein FIG. 1 is a side view of an entire gas turbine engine;

FIG. 2 is a sectional view taken along a line 2—2 in FIG. 1;

FIG. 3 is an enlarged sectional view taken along a line 3—3 in FIG. 2 (a sectional view of combustion gas passages);

FIG. 4 is an enlarged sectional view taken along a line 4—4 in FIG. 2 (a sectional view of air passages);

FIG. 5 is an enlarged sectional view taken along a line 5—5 in FIG. 4;

FIG. 6 is an enlarged sectional view taken along a line 6—6 in FIG. 4;

FIG. 7 is a developed view of a folding plate blank;

FIG. 8 is a perspective view of an essential portion of a heat exchanger; and FIG. 9 is a pattern view showing flows of a combustion gas and air.

BEST MODE FOR CARRYING OUT THE INVENTION

The present invention will now be described by way of an embodiment with reference to the accompanying drawings.

Figure 1:
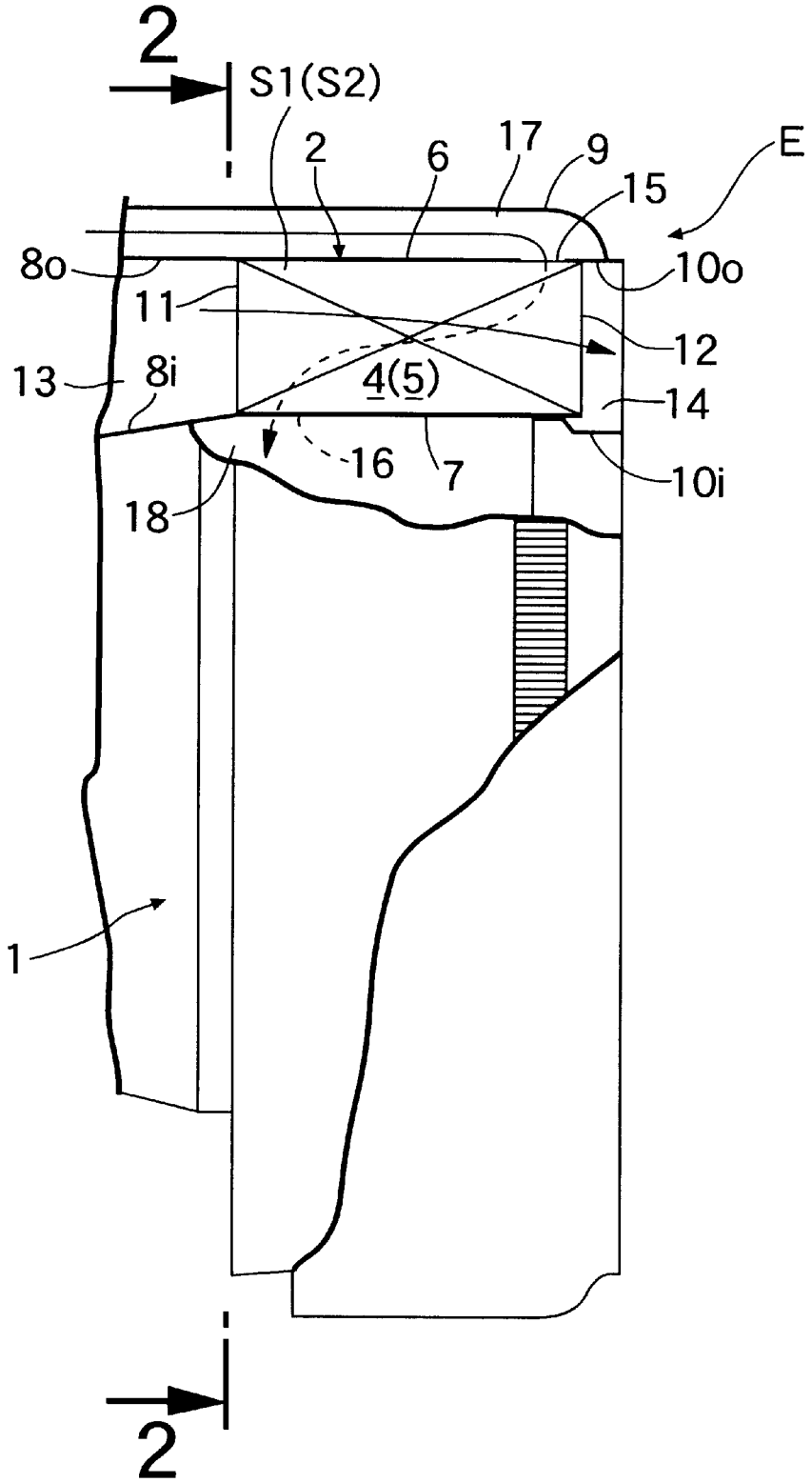
Figure 2:
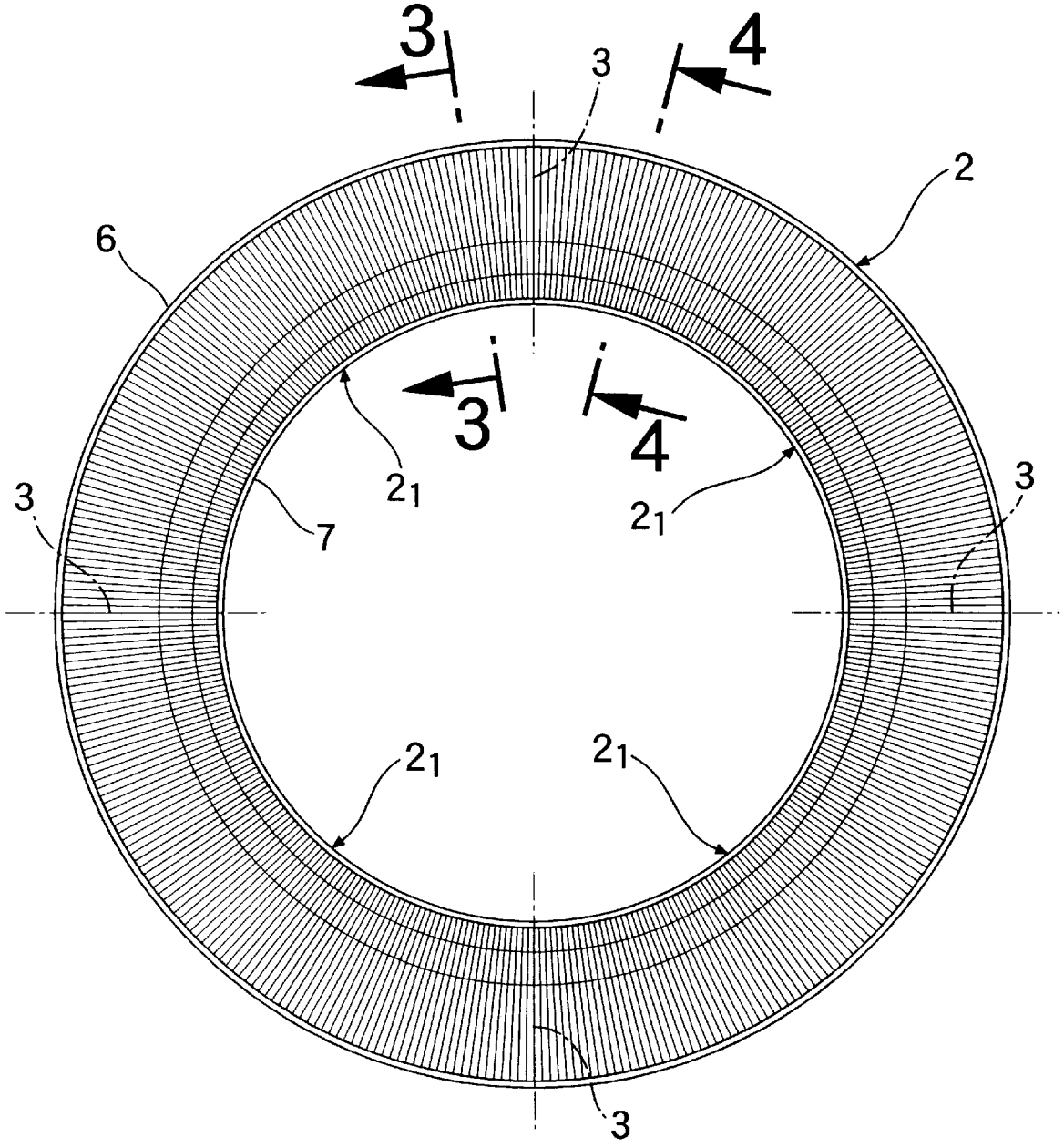

As shown in FIGS. 1 and 2, a gas turbine engine E includes an engine body 1 in which a combustor, a compressor, a turbine and the like (which are not shown) are accommodated. An annular-shaped heat exchanger 2 is disposed to surround an outer periphery of the engine body 1. The heat exchanger 2 comprises four modules 21 having a center angle of 90° and arranged in a circumferential direction with bond surfaces 3 interposed therebetween. Combustion gas passages 4 and air passages 5 are circumferentially alternately provided in the heat exchanger 2 (see FIG. 5), so that a combustion gas of a relative high temperature passed through turbine is passed through the combustion gas passages 4, and air of a relative low temperature compressed in the compressor is passed through the air passages 5. A section in FIG. 1 corresponds to the combustion gas passages 4, and the air passages 5 are defined adjacent this side and the other side of the combustion gas passages 4.

The sectional shape of the heat exchanger 2 taken along its axis is an axially longer and radially shorter quadrilateral shape. A radially outer peripheral surface of the heat exchanger 2 is closed by a large-diameter cylindrical outer casing 6, and a radially inner peripheral surface of the heat exchanger 2 is closed by a small-diameter cylindrical inner casing 7. A front outer duct member **8*o* and a front inner duct member 8*i* are provided in a front portion of the heat exchanger 2, so that they are connected to front ends of the outer and inner casings 6 and 7, respectively. A rear outer duct member 10*o* and a rear inner duct member 10*i* are provided in a rear portion of the heat exchanger 2, so that they are connected to rear ends of the outer and inner casings 6 and 7**, respectively.

Each of the combustion gas passages 4 in the heat exchanger 2 includes a combustion gas passage inlet 11 and a combustion gas passage outlet 12 at left and right portions of FIG. 1. A combustion gas introducing space (referred to as a combustion gas introducing duct) 13 defined between the front outer duct member **8*o* and the front inner duct member 8*i* is connected at its downstream end to the combustion gas passage inlet 11, and a combustion gas discharging space (referred to as a combustion gas discharging duct) 14 defined between the rear outer duct member 10*o* and the rear inner duct member 10*i* is connected at its upstream end to the combustion gas passage outlet 12**.

Each of the air passages 5 in the heat exchanger 2 includes an air passage inlet 15 and an air passage outlet 16 at the right and upper portion and the left and lower portion of FIG. 1, respectively. An air introducing space (referred to as an air introducing duct) 17 defined along an inner periphery of a rear outer housing 9 is connected at its downstream end to the air passage inlet 15. An air discharging space (referred to as an air discharging duct) 18 extending within the engine body 1 is connected at its upstream end to the air passage outlet 16.

Figure 3:
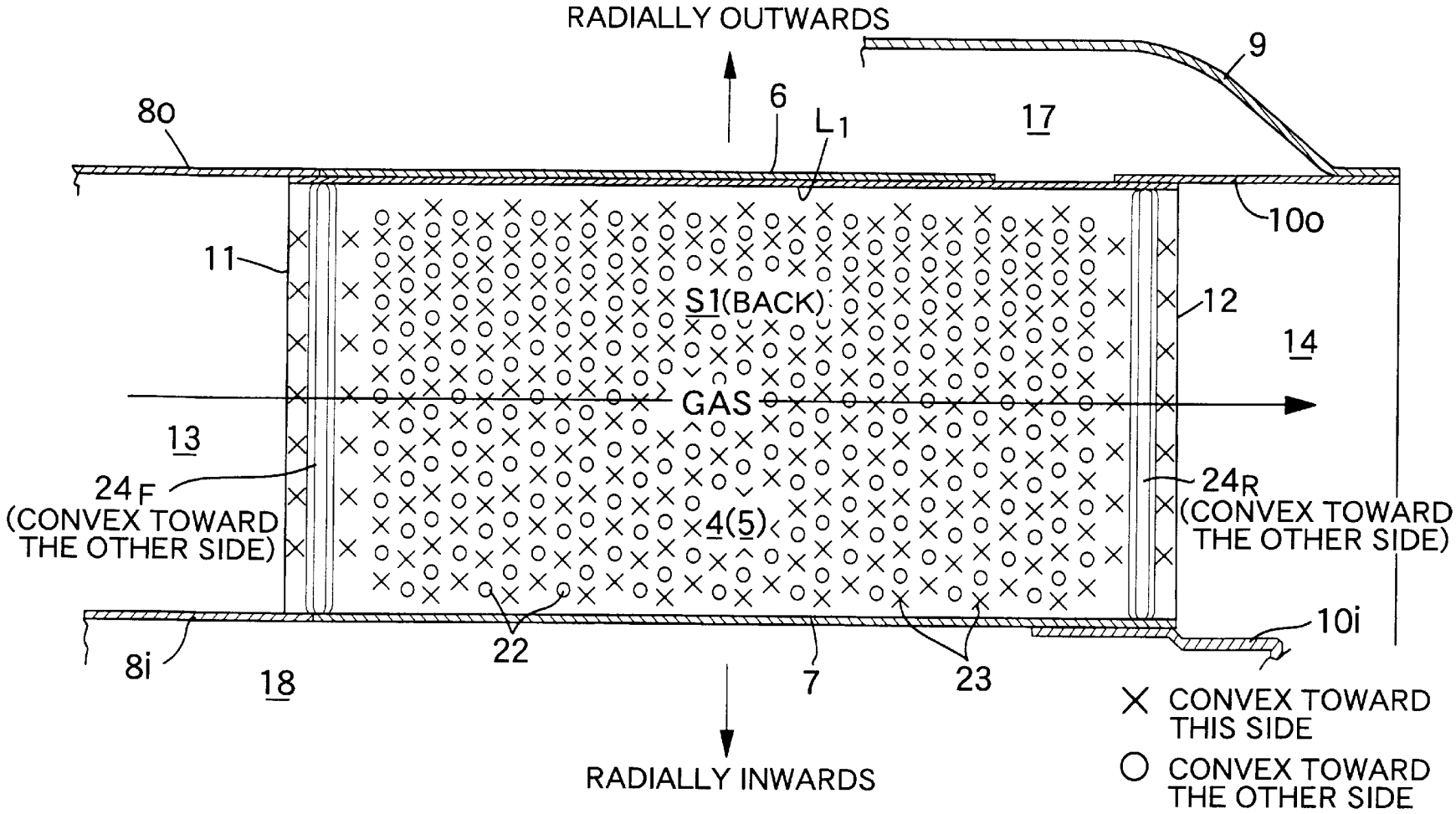
Figure 4:
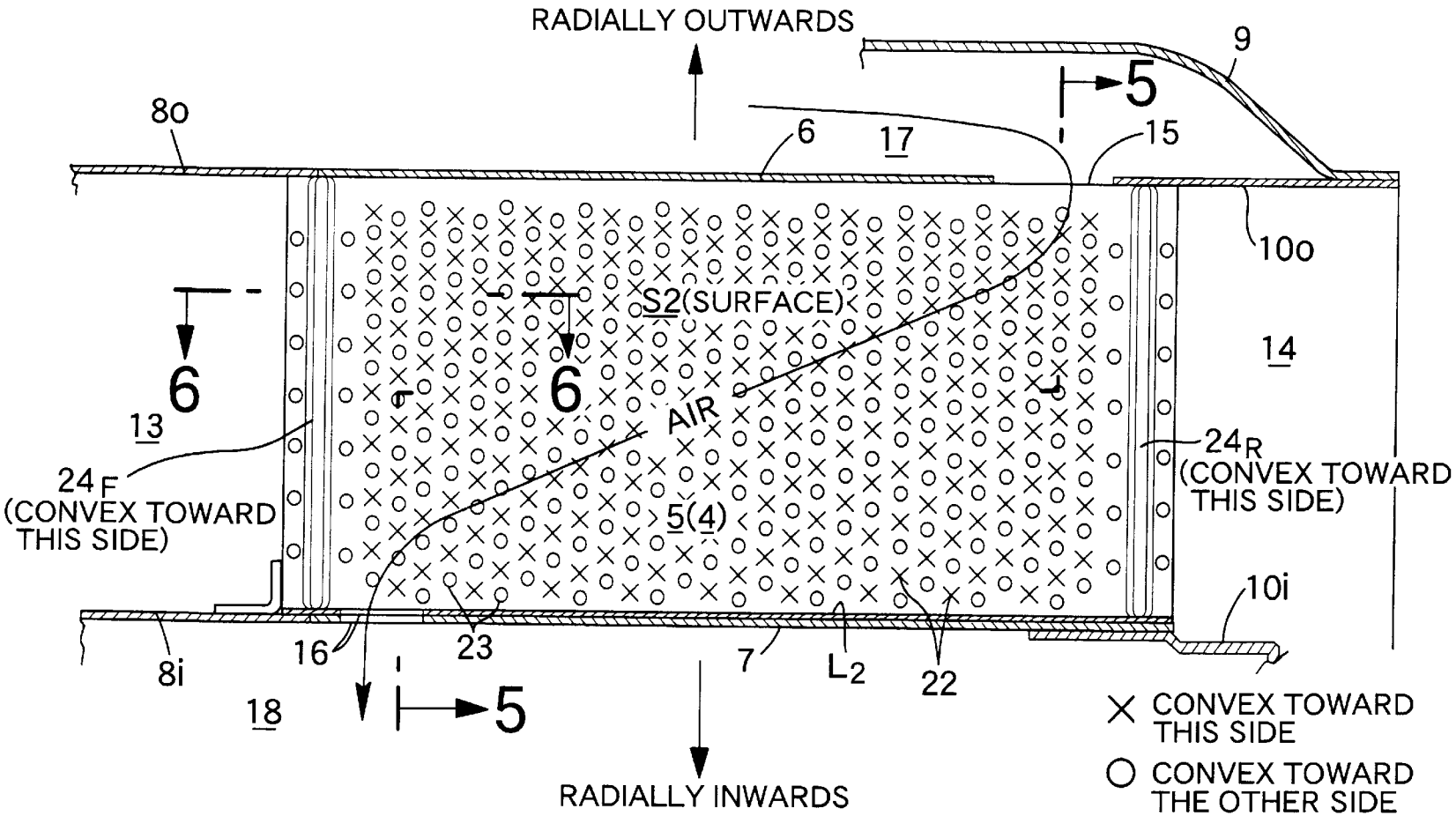
Figure 9:
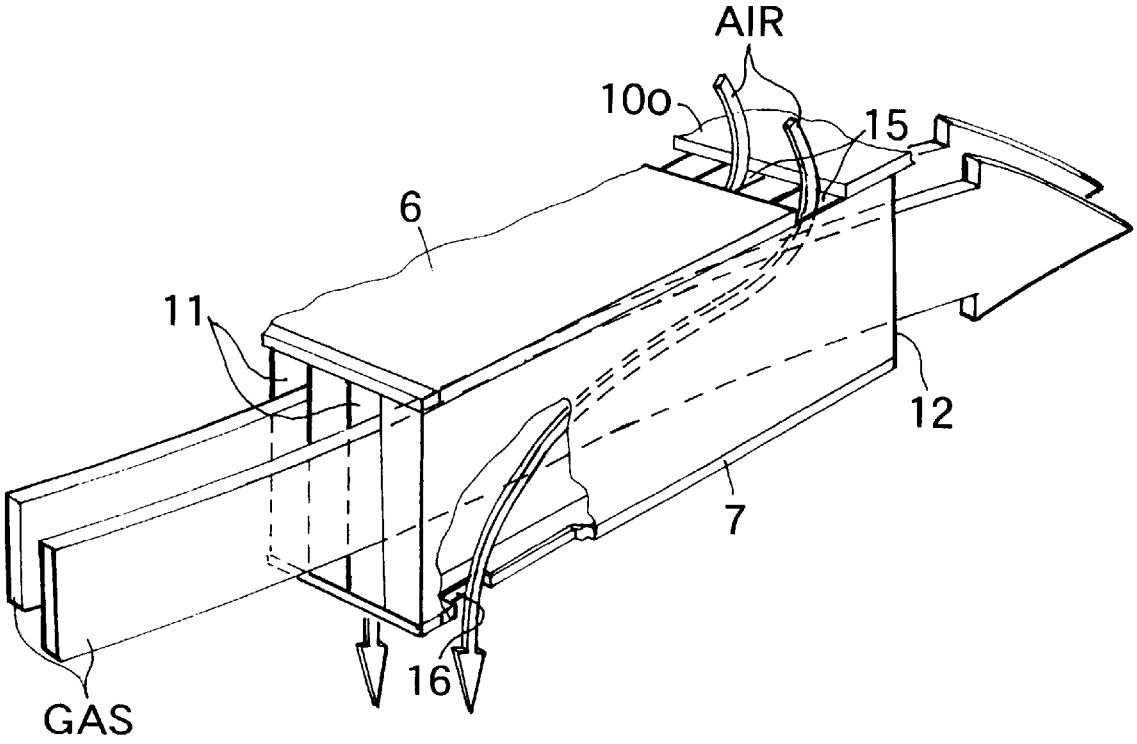

In this manner, the combustion gas and the air flow in opposite directions from each other and cross each other as shown in FIGS. 3, 4 and 9, whereby a counter flow and a so-called cross-flow are realized with a high heat-exchange efficiency. Thus, by allowing a high-temperature fluid and a low-temperature fluid to flow in opposite directions from each other, a large difference in temperature between the high-temperature fluid and the low-temperature fluid can be maintained over the entire length of the flow paths, thereby enhancing the heat-exchange efficiency.

The temperature of the combustion gas which has driven the turbine is about 600 to 700° C. in the combustion gas passage inlets 11. The combustion gas is cooled down to about 300 to 400° C. in the combustion gas passage outlets 12 by conducting a heat-exchange between the combustion gas and the air when the combustion gas passes through the combustion gas passages 4. On the other hand, the temperature of the air compressed by the compressor is about 200 to 300° C. in the air passage inlets 15. The air is heated up to about 500 to 600° C. in the air passage outlets 16 by conducting a heat-exchange between the air and the combustion gas, which occurs when the air passes through the air passages 5.

The structure of the heat exchanger 2 will be described below with reference to FIGS. 3 to 8.

Figure 7:
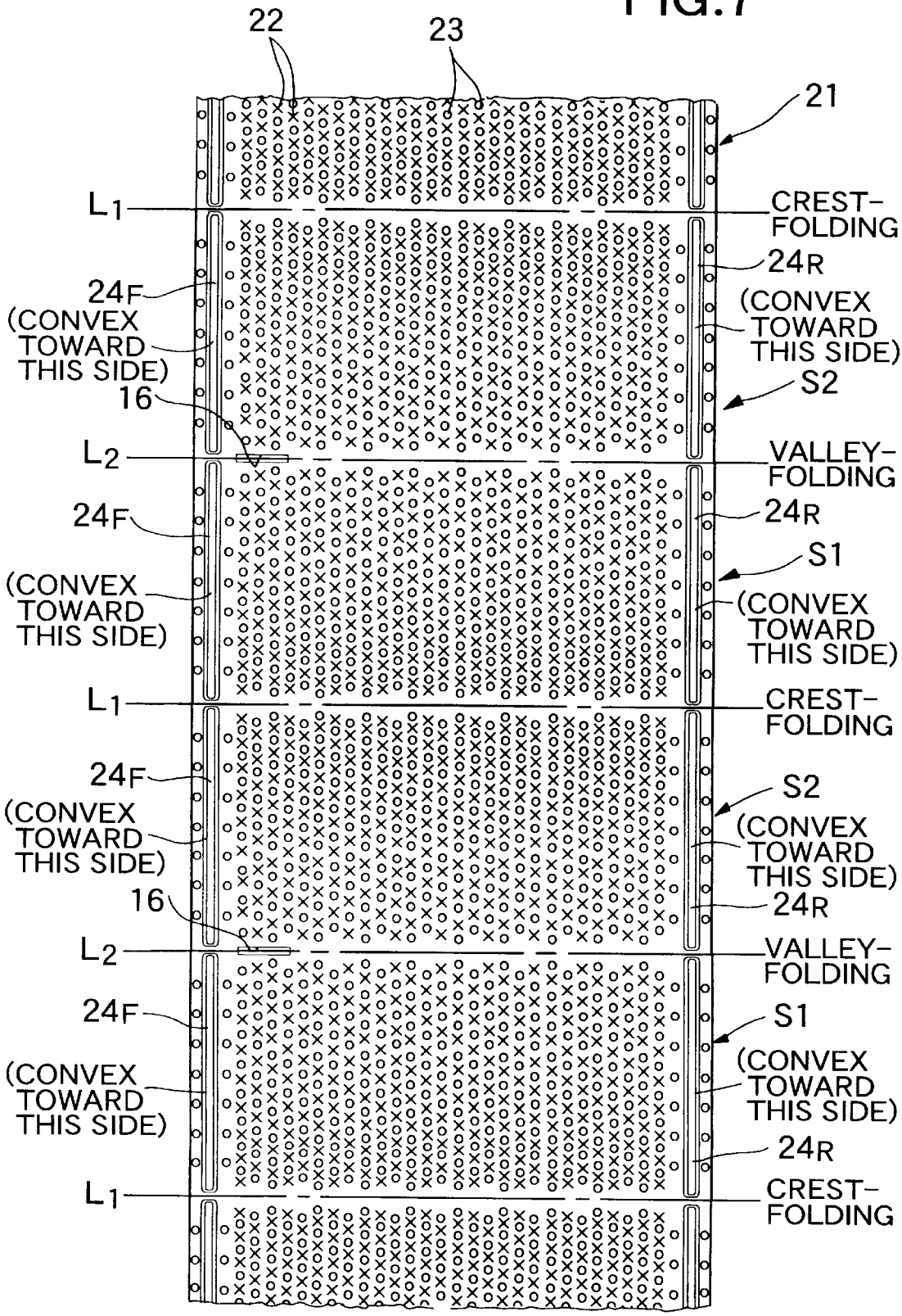
Figure 8:
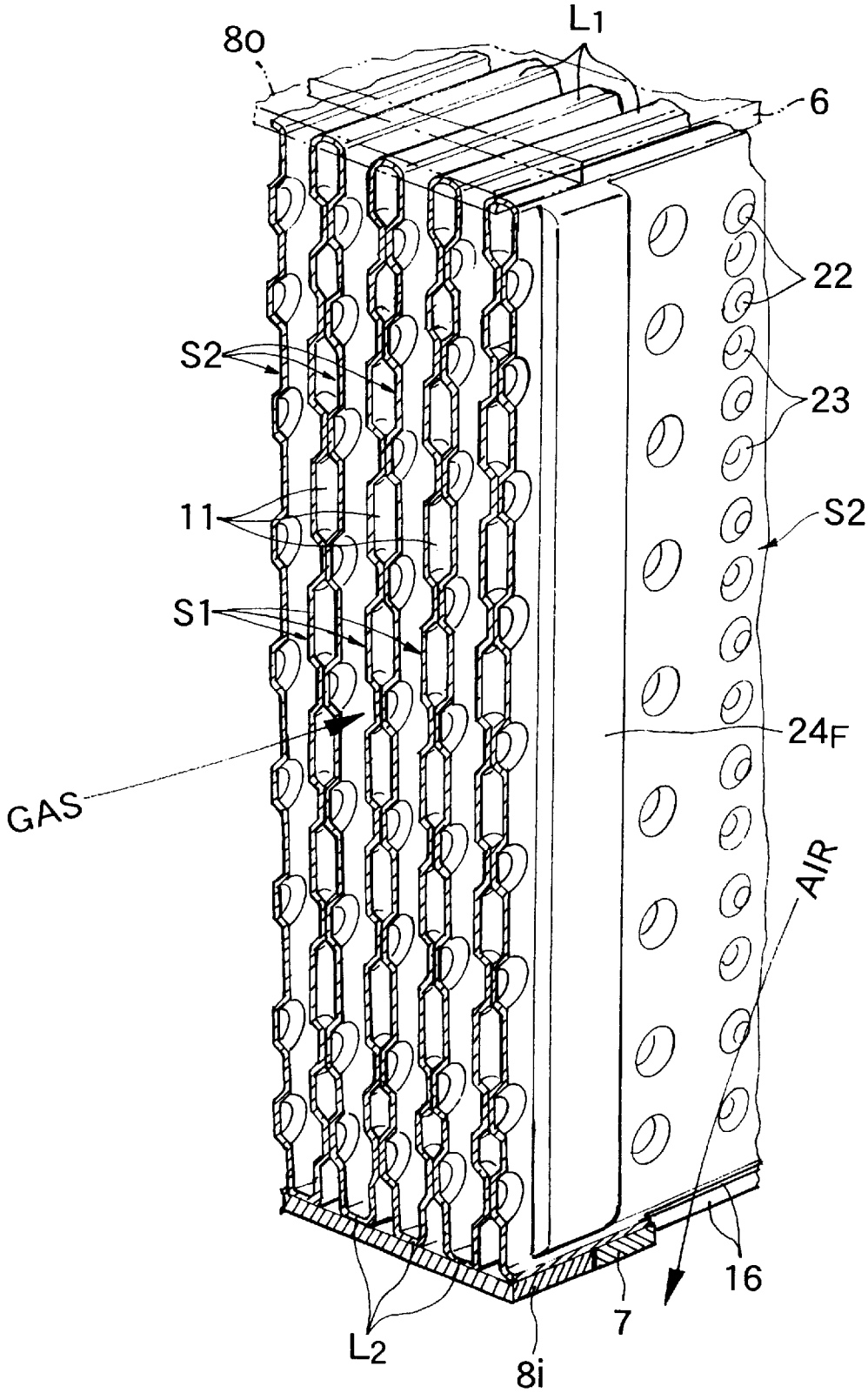

As shown in FIGS. 3, 4 and 7, each of the modules $\mathbf{2}_1$ of the heat exchanger 2 is made from a folding plate blank 21 (see FIG. 7) produced by previously cutting a thin metal plate such as a stainless steel into a predetermined shape and then forming an irregularity on a surface of the cut plate by pressing. The folding plate blank 21 is comprised of first heat-transfer plates S1 and second heat-transfer plates S2 disposed alternately, and is folded into a zigzag fashion along crest-folding lines $L_1$ and valley-folding lines $L_2$. The term "crest-folding" means folding into a convex toward this side or a closer side from the drawing sheet surface, and the term "valley-folding" means folding into a convex toward the other side or a far side from the drawing sheet surface. Each of the crest-folding lines $L_1$ and the valley-folding lines $L_2$ is not a simple straight line, but actually comprises an arcuate folding line or two parallel and adjacent folding lines for the purpose of forming a predetermined space between each of the first heat-transfer plates S1 and each of the second heat-transfer plates S2.

A large number of first projections 22 and a large number of second projections 23, which are disposed at unequal distances, are formed on each of the first and second heat-transfer plates S1 and S2 by pressing. The first projections 22 indicated by a mark X in FIG. 7 protrude toward this side on the drawing sheet surface of FIG. 7, and the second projections 23 indicated by a mark O in FIG. 7 protrude toward the other side on the drawing sheet surface of FIG. 7. The first and second projections 22 and 23 are arranged alternately (i.e., so that the first projections 22 are not continuous to one another and the second projections 23 are not continuous to one another). Front projection stripes $\mathbf{24}_F$ and rear projection stripes $\mathbf{24}_R$ which protrude toward this side on the drawing sheet surface of FIG. 7, are formed on front and rear ends of each of the first and second heat-transfer plates S1 and S2 by pressing.

The first projections 22, the second projections 23, the front projection stripes $\mathbf{24}_F$ and the rear projection stripes $\mathbf{24}_R$ of the first heat-transfer plate S1 shown in FIG. 3 are in an opposite recess-projection relationship with respect to that in the first heat-transfer plate S1 shown in FIG. 7. This is because FIG. 3 shows a state in which the first heat-transfer plate S1 is viewed from the back side.

Figure 6:
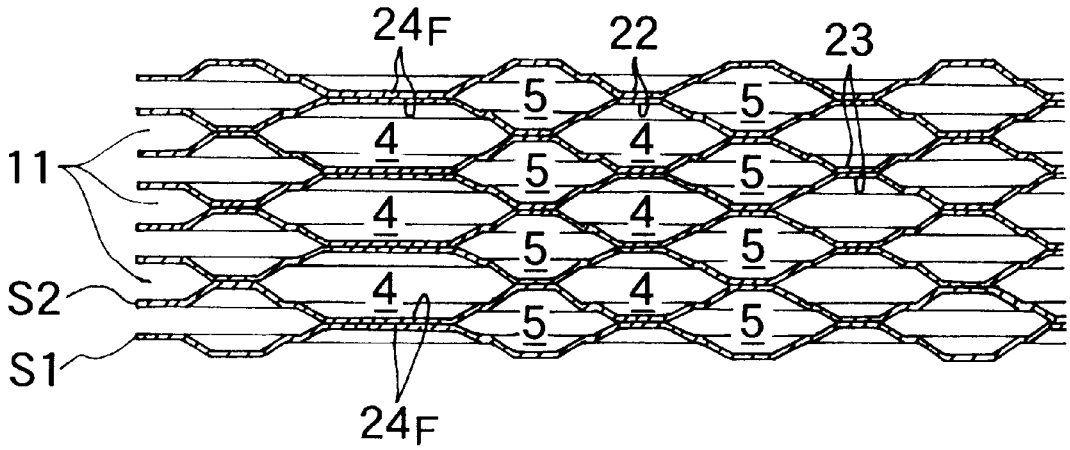

As can be seen from FIGS. 5 to 7, when the first and second heat-transfer plates S1 and S2 of the folding plate blank 21 are folded along the crest-folding lines $L_1$ to form the combustion gas passages 4 between both the heat-transfer plates S1 and S2, tip ends of the second projections 23 of the first heat-transfer plate S1 and tip ends of the second projections 23 of the second heat-transfer plate S2 are brought into abutment against each other and brazed to each other. At this time, the front projection stripes $24_F$ and the rear projection stripes $24_R$ are spaced apart from each other, and the front and rear portions of the combustion gas passages 4 are permitted to communicate with the combustion gas passage inlet 11 and the combustion gas passage outlet 12, respectively.

When the first heat-transfer plates S1 and the second heat-transfer plates S2 of the folding plate blank 21 are folded along the valley-folding line $L_2$ to define the air passages 5 between the heat-transfer plates S1 and S2, tip ends of the first projections 22 of the first transfer plate S1 and tip ends of the first projections 22 of the second heat-transfer plate S2 are brought into abutment against each other and brazed to each other. At this time, the front and rear projection stripes $24_F$ and $24_R$ are brought into abutment against each other and brazed to each other, thereby closing the front portions of the air passages 5 adjacent the combustion gas passage inlet 11 and the rear portions of the air passages 5 adjacent the combustion gas passage outlet 12. A state in which the air passages 5 have been closed by the front projection stripes $24_F$ is shown in FIG. 6.

As can be seen from FIGS. 4 and 5, the rear end of the outer casing 6 and a front end of the rear outer duct member 10*o* to which the crest-folding lines $L_1$ have been brazed are opposed to each other at a predetermined gap left therebetween, and the air passage inlet 15 is defined in this gap. The air passage outlet 16 formed into a small bore shape is defined to extend through front portions of the valley-folding lines $L_2$and a front portion of the inner casing 7. Therefore, air flowing in the air introducing duct 17 is guided through the air passage inlet 15 to the air passages 5 between the first and second heat-transfer plates S1 and S2, and discharged therefrom through the small bore-shaped air passage outlet 16 defined in the valley-folding lines $L_2$ and the inner casing 7 to the air discharging duct 18.

Each of the first and second projections 22 and 23 has a substantially truncated conical shape, and the tip ends of the first and second projections 22 and 23 are in surface contact with each other to enhance the brazing strength. Each of the front and rear projection stripes $24_F$ and $24_R$ has also a substantially trapezoidal section, and the tip ends of the front and rear projection stripes $24_F$ and $24_R$ are also in surface contact with each other to enhance the brazing strength.

When the folding plate blank 21 is folded in the zigzag fashion, the adjacent crest-folding lines $L_1$ cannot be brought into direct contact with each other, but the distance between the crest-folding lines $L_1$ is maintained constant by the contact of the first projections 22 to each other. In addition, the adjacent valley-folding lines $L_2$ cannot be brought into direct contact with each other, but the distance between the valley-folding lines $L_2$ is maintained constant by the contact of the second projections 23 to each other.

When the folding plate blank 21 is folded in the zigzag fashion to produce the modules $2_1$ of the heat exchanger 2, the first and second heat-transfer plates S1 and S2 are disposed radiately from the center of the heat exchanger 2. Therefore, (the distance between the adjacent first and second heat-transfer plates S1 and S2 assumes the maximum in the radially outer peripheral portion which is in contact with the outer casing 6, and the minimum in the radially inner peripheral portion which is in contact with the inner casing 7. For this reason, the heights of the first projections 22, the second projections 23, the front projection stripes $24_F$ and the rear projection stripes $24_R$ are gradually increased outwards from the radially inner side, whereby the first and second heat-transfer plates S1 and S2 can be disposed exactly radiately (see FIG. 5).

By employing the above-described structure of the radiately folded plates, the outer casing 6 and the inner casing 7 can be positioned concentrically, and the axial symmetry of the heat exchanger 2 can be maintained accurately.

Moreover, the first and second heat-transfer plates S1 and S2 are of the same rectangular shape and hence, the folding plate blank 21 is also of a simple band shape, leading to the enhanced material yield, as compared with the case where ends of the first and second heat-transfer plates S1 and S2 are cut into an angle shape. Especially, the front projection stripes $24_F$ and the rear projection stripes $24_R$ are employed for closing the air passages 5 and hence, there is not a degradation in the material yield produced when flaps for closing the air passages 5 are projectingly provided at ends of the rectangular first and second heat-transfer plates S1 and S2.

In addition, the front outer duct member 8*o*, the front inner duct member 8*i*, the rear outer duct member 10*o* and the rear inner duct member 10*i* for defining the high-temperature fluid introducing duct 13, the high-temperature fluid discharging duct 14, the low-temperature fluid introducing duct 17 and the low-temperature fluid discharging duct 18 are brazed to the crest-folding lines $L_1$ and the valley-folding lines $L_2$ of the first and second heat-transfer plates S1 and S2. Therefore, as compared with the case where they are brazed to the end surfaces of the first and second heat-transfer plates S1 and S2 cut into an angle-shape, the number of operating steps required for the above-described cutting is naturally reduced, and moreover, the brazing area is increased to enhance the operability and the strength.

By forming the heat exchanger 2 by a combination of the four modules $2_1$ having the same structure, the manufacture of the heat exchanger can be facilitated, and the structure of the heat exchanger can be simplified. In addition, by folding the folding plate blank 21 radiately and in the zigzag fashion to continuously form the first and second heat-transfer plates S1 and S2, the number of parts and the number of brazing points can remarkably be decreased, and moreover, the dimensional accuracy of a completed article can be enhanced, as compared with a case where a large number of first heat-transfer plates S1 independent from one another and a large number of second heat-transfer plates S2 independent from one another are brazed alternately.

As can be seen from FIG. 5, when the modules $2_1$ of the heat changer 2 are bonded to one another at the bond surfaces 3 (see FIG. 2), end edges of the first heat-transfer plates S1 folded into a J-shape beyond the crest-folding line $L_1$ and end edges of the second heat-transfer plates S2 cut rectilinearly at a location short of the crest-folding line $L_1$ are superposed on each other and brazed to each other. By employing the above-described structure, a special bonding member for bonding the adjacent modules $2_1$ to each other is not required, and a special processing for changing the thickness of the folding plate blank 21 is not required. Therefore, the number of parts and the processing cost are reduced, and further an increase in heat mass in the bonded zone is avoided. Moreover, a dead space which is neither the combustion gas passages 4 nor the air passages 5 is not created and hence, the increase in flow path resistance is suppressed to the minimum, and there is not a possibility that the heat exchange efficiency may be reduced.

During operation of the gas turbine engine E, the pressure in the combustion gas passages 4 is relatively low, and the pressure in the air passages 5 is relatively high. For this reason, a flexural load is applied to the first and second heat-transfer plates S1 and S2 due to a difference between the pressures, but a sufficient rigidity capable of withstanding such load can be obtained by virtue of the first and second projections 22 and 23 which have been brought into abutment against each other and brazed with each other.

In addition, the surface areas of the first and second heat-transfer plates S1 and S2 (i.e., the surface areas of the combustion gas passages 4 and the air passages 5) are increased by virtue of the first and second projections 22 and 23. Moreover, the flows of the combustion gas and the air are agitated and hence, the heat exchange efficiency can be enhanced.

Although the embodiment of the present invention have been described in detail, it will be understood that the present invention is not limited to the above-described embodiment, and various modifications may be made without departing from the spirit and scope of the invention defined in claim.

For example, the heat exchanger 2 for the gas turbine engine E has been illustrated in the embodiment, but the present invention can be applied to heat exchangers for other applications.

What is claimed is:

1. A heat exchanger formed from a folding plate blank (21) comprising a plurality of first quadrilateral heat-transfer plates (S1) and a plurality of second quadrilateral heat-transfer plates (S2) which are alternately connected together through first and second folding lines ($L_1$ and $L_2$), said folding plate blank (21) being folded in a zigzag fashion along said first and second folding lines ($L_1$ and $L_2$), thereby defining axially extending high-temperature and low-temperature fluid passages (4 and 5) alternately in a circumferential direction, wherein radially outer peripheral walls (6, 80 and 100) are brazed to said plurality of first folding lines ($L_1$) located on a radially outer side and radially inner peripheral walls **(7, 8*i* and 10*i*) are brazed to said plurality of second folding lines ($L_2$ ) located on a radially inner side, thereby closing radially outer and inner peripheries of said axially extending high-temperature and low-temperature fluid passages (4 and 5), said high-temperature passages and said low-temperature passages being substantially parallel each other, while defining high-temperature fluid ducts (13 and 14) connected to said high-temperature fluid passages (4) and low-temperature fluid ducts (17 and 18) connected to said low-temperature fluid passages (5)**;

wherein a high-temperature fluid passage inlet (11) and a high-temperature fluid passage outlet (12) are formed in openings at axially opposite ends of said high-temperatures fluid passages (4); and wherein projection stripes ($24_f$ and **24*r*) provided on said first and second heat-transfer plates (S1 and S2) are brazed to one another, thereby closing axially opposite ends of said low-temperature fluid passages (5), while defining a low-temperature fluid passage inlet (15) in one of said radially outer peripheral walls (6, 8*o* and 10*o*) on the side of said high-temperature fluid passage outlet (12), and a low-temperature fluid passage outlet (16) on the inner peripheral walls (7, 8*i* and 10*i*) on the side of said high-temperature fluid passage inlet (11)**.

* * * * *